US008764520B1

(12) United States Patent
Fields

(10) Patent No.: US 8,764,520 B1
(45) Date of Patent: Jul. 1, 2014

(54) VACUUM BUFFER ASSEMBLY

(71) Applicant: Surtec, Inc., Tracy, CA (US)

(72) Inventor: William A. Fields, Livermore, CA (US)

(73) Assignee: Surtec, Inc., Tracy, CA (US)

( * ) Notice: Subject to any disclaimer, the term of this patent is extended or adjusted under 35 U.S.C. 154(b) by 0 days.

(21) Appl. No.: 13/927,997

(22) Filed: Jun. 26, 2013

(51) Int. Cl.
*B24B 55/06* (2006.01)

(52) U.S. Cl.
USPC ..... 451/456; 15/347; 15/385; 15/420

(58) Field of Classification Search
USPC ..... 451/456; 15/347, 385, 420
See application file for complete search history.

(56) References Cited

U.S. PATENT DOCUMENTS 5,388,305 A * 2/1995 Fields ..... 15/385
5,713,785 A * 2/1998 Nishio ..... 451/451
5,974,626 A * 11/1999 Wood et al. ..... 15/385
6,370,728 B1 * 4/2002 Burns ..... 15/320
7,056,198 B2 * 6/2006 Smith ..... 451/350

* cited by examiner

*Primary Examiner* — Lee D Wilson
*Assistant Examiner* — Shantese McDonald
(74) *Attorney, Agent, or Firm* — Kilpatrick Townsend & Stockton LLP

(57) ABSTRACT

Disclosed are improvements to a high speed power buffer assembly provided with a dust evacuation system. The assembly includes a hood depending from the chassis to encircle the high speed rotating buffer pad, a peripheral skirt depended from the chassis, a dust collection aperture adjacent the buffer penetrating the hood for the outlet of dust to the exterior of the hood, a curved dust collector chute, aligned and in communication with the dust collection aperture, and a dust collection bag, communicated with the dust collector output. The skirt has inclined grooves to co-act with the buffer pad to entrain air from the outside of the skirt to the inside. Given the arrangement of the foregoing features, the dust evacuation system can operate without the use of a vacuum pump.

18 Claims, 7 Drawing Sheets

VACUUM BUFFER ASSEMBLY

BACKGROUND OF THE INVENTION

The present invention relates to high speed buffer assemblies utilized for large polished floor surfaces, such as those found in super markets and other retail establishments.

Large polished floor surfaces are the standard for the modern retail environment. For both appearance and cleanliness, these surfaces are waxed and buffed. In the modern store environment, relatively large (from one-half to three feet in diameter), high speed buffer assemblies are utilized.

The standard construction of these buffer assemblies is relatively straightforward. They usually include a chassis mounted over a set of wheels, the chassis carrying a motor for driving a disc shaped buffer pad. The buffer pads depend from the chassis for polishing the floor. A hood is mounted to the chassis and depends over the high speed rotating buffer pad when polishing a surface. This hood encircles the buffer pad and serves to prevent the rotating buffer pad from coming in contact with anything above or to the side of the buffer pad. Use of these buffer assemblies, where the floors are first swept and/or mopped, and thereafter waxed and buffed, results in a clean and inviting floor in a store or room.

Unfortunately, such buffing is far from dust free. The large buffing pads, rotating in the order of 2,000 revolutions per minute, dislodge dust from the polishing surface during operation. If not contained, this dust is expelled out from under the hood edges at the sides of the rotating buffer pad where it escapes the hood. Such dust dislodgment and escape is especially aggravated when the buffing pad, during polishing, comes in contact with irregularities in the surface being polished, such as a seam in the flooring.

Further, the dust that dislodges and escapes is particularly unpleasant. Typically, it is of extremely small particle size—slightly larger than one micron—and when escaping is centrifugally thrown outward of the buffer during the high speed buffing operation.

Left uncontained, this dust dislodgment and escape represents a serious problem. Dust from buffing which is thrown outward at high speed, billows upwardly from the buffing site, and settles everywhere, including high surfaces that are relatively removed from the floor surface being polished. Further, and while the dust is airborne, it is often near the nose and mouth of workers operating the buffer apparatus. Consequently, it can constitutes a health hazard due to the possibility of inhalation.

Attempts to solve this problem have included depending skirts to confine dust flow to within the hood suspended over and around the rotating buffer. While these skirts enhance confinement of the dust, they still allow some dust to escape from the buffer assembly. Many buffer assemblies combine the buffer pad with a vacuum dust evacuator. Such evacuators either rely on air entrained by the rotating buffer and have independently powered vacuum apparatus to capture the dust by venting air from under the protective hood to collection bags.

Further, the vacuum only systems which merely communicate to the hood are not able to draw sufficient vacuum; the rotating air entrained by the high speed rotating buffer simply bypasses the vacuum inlet given its configuration. In the past, attempts to allow the rotating buffer to supply the total dust evacuation action were insufficient; dust was still broadcast at the periphery of the buffing pad, out from under the hood or skirt. The present invention improves upon the systems of the past and is able to supply the total dust evacuation action by the rotating buffer given the configuration of the features disclosed herein.

BRIEF SUMMARY OF THE INVENTION

A high speed power buffer assembly is provided with a dust evacuation system. The assembly has a chassis for movement along a directed path over a surface to be polished, a motor mounted to the chassis, and a high speed polishing buffer pad depending from said chassis the buffer pad being driven by the motor in rotating contact with the floor along a preselected direction of rotation. The dust evacuation system includes a hood depending from the chassis to encircle the high speed rotating buffer pad, a peripheral skirt depended from the chassis immediate the periphery of the hood, a dust collection aperture adjacent the buffer pad penetrating the hood for the outlet of dust from inside said hood to the exterior of the hood, the aperture having an inlet on the inside of the hood and an outlet on the outside of the hood, a dust collector output, aligned and in communication with the dust collection aperture output on the outside of the hood, and a dust collection bag, communicated with the dust collector output. The skirt, at the extremity adjacent the surface to be polished has grooves inclined with respect to the radial direction of rotation of the buffer pad to slant from outside of the skirt to the inside of the skirt in the direction of buffer disc rotation to co-act with the buffer pad when rotating to entrain air from the outside of the skirt to the inside of the skirt. The dust collection aperture inlet is defined by a first end, a second end, a first side and a second side, where the first end is wider than the second end. Given the arrangement of the foregoing features the dust evacuation system can operate without the use of a vacuum pump.

The peripheral skirt depends from a hood overlying the high speed rotating buffer pad. This skirt, at the extremity adjacent the surface to be polished, is supplied with angularly inclined grooves sloped away from the radial disposition with respect to the buffer pad. These angularly inclined grooves slope from the outside of the skirt to the inside of the skirt in the direction of buffer pad rotation at the buffer pad periphery and are maintained by the telescoping skirt immediately adjacent the surface being polished. Entrained air is drawn at the surface being polished in the direction of buffer disc rotation from the outside of the skirt to the inside of the skirt through the slanting louvers establishing a buffer dust confining boundary at the depending peripheral skirt immediately adjacent the floor. In some embodiments, a skirt lip seal attaches to the skirt at its bottom where the skirt would otherwise be directly adjacent to the surface being polished. The skirt lip seal further aids in establishing the buffer dust confining boundary preventing entrained air from escaping the skirt and hood, to the outside, and maximizing the amount of entrained air retained within the skirt and hood.

Overlying the buffer pad, the hood defines an internal cavity which encircles the rotating buffer. The hood has a collection aperture, which during operation, channels the entrained air within the hood and skirt to outside the hood to a chute. The collection aperture is located in and penetrates the side wall of hood. The aperture shape is defined by four sides, a first end, second end, and two sides. The first end is wider than the second end. The first end is located first in the rotational direction with respect to the second end and the two sides connect the first and second ends. This results in the aperture tapering in the rotational direction. This tapering aids in channeling and accelerating the entrained air out of the hood through the aperture to the outside of the hood where it is further directed to chute discuss in further detail below.

In some embodiments, a deflector is utilized on the second end of the aperture. Additionally, sidewalls, arising from each of the two sides, extend into the hood cavity. The deflector and sidewalls further aid in collecting and channeling the entrained air through the aperture.

At the exterior of the hood and aligned with the aperture, a chute is provided. This chute, at the end which aligns with the aperture, has an inlet geometry which matches the aperture. The chute tapers as it protrudes away from the hood. Its shape, at the end opposite the aperture, the chute outlet, is configured to mate with a hose connected to a collection bag or a vacuum pump.

A dust collector vacuum can communicate with the dust collection chute and thereby, with the aperture on the outside of the hood, drawing suction through the dust collection aperture. The vacuum outputs, under positive pressure, to a paper micro filter bag having the capability of collecting particles in the order of one micron.

In operation, air at the skirt is provided with a positive boundary which inhibits scattering dust or debris particles as the buffer passes over a floor surface being polished. This boundary is enhanced by the inclusion of the skirt lip seal. Dust contaminated air, under the hood and skirt, is entrained and rotates under the protective hood. The air encountering such rotation enters into the hood cavity, encountering the deflector and sidewalls of the aperture, when it is then channeled through the aperture under positive pressure out to the dust collector chute. The air dust combination then travels to the communicated collection bag or dust vacuum. This dust contaminated air is discharged under positive pressure through to the dust collecting micro filter air bag for substantial and improved dust free operation of the buffer assembly.

Thus, the skirt with the angled cuts allow air to flow in an inward direction to the underside of the hood body. This establishes a dust containment boundary between the surface being polished on the inside of the hood and remainder of the floor surface on the exterior of the hood. The skirt lip seal improves the efficacy of this boundary resulting in superior dust contamination collection.

During operation the buffer pad turning at high speed inside the hood and depending skirt, causes this inward flow of air to flow around under the protective hood toward the aperture.

The improved aperture, including the deflectors on its end and two sides, catches the air and entrained dust and directs it out of the hood into the chute and into the collection bag or vacuum. Such redirection occurs under a positive pressure produced by the rotating buffer pad directing air through the aperture and then the chute.

A connected commercially available collection bag is utilized having the ability to trap particles down to a dimension of one micron. This bag effectively collects the dust and keeps it in the bag, not allowing particles larger than one micron from flowing back into the air adjacent the buffing site.

For a further understanding of the nature and advantages of the invention, reference should be made to the following description taken in conjunction with the accompanying figures. It is to be expressly understood, however, that each of the figures is provided for the purpose of illustration and description only and is not intended as a definition of the limits of the embodiments of the present invention.

BRIEF DESCRIPTION OF THE DRAWINGS

Other objects, features and advantages of this invention will be more apparent after referring to the following description and attached drawings in which.

DETAILED DESCRIPTION OF THE INVENTION

Vacuum buffer assemblies of the prior art include a chassis connected to a hood over a rotating buffer pad and a skirt depending from said hood, where the skirt has louvers at intervals circumventing the skirt at the side of the skirt which interfaces with the surface to be polished. These particular prior art buffers were problematic in that dust was not fully contained and vacuum pumps were required to draw the dust captured under the hood out to a collection bag. Other Vacuum buffers of the prior art, utilized slanted louvers relative to the direction of the rotation of the buffer pad, to draw air in through the louvers and entrain an air and dust combination under the hood and then out through an aperture to a collection bag. These prior art vacuum buffers operate to entrain combined air and dust under the hood and direct it through an aperture and chute under positive pressure to a collection vacuum eliminating the requirement for a vacuum pump to pull the dust out from under the hood. These prior art buffers however exhibited vacuum loss and dust leakage given their configuration. One such prior art vacuum buffer is disclosed in U.S. Pat. No. 5,388,305, the full disclosure of which is hereby incorporated herein by reference.

This disclosure is directed toward various improvements to the vacuum buffer assembly of the '305 patent. These improvements include: improved sealing of air and dust inside the vacuum hood and skirt by way of a skirt lip seal, enhanced egress of the air and dust combination from the vacuum buffer hood area to the collection bag by way of an improved chute geometry, enhanced operation of the vacuum buffer given the combination of the skirt lip seal and the geometry of the hood including elimination of skirt mounting slots that allowed for dust leakage and would easily bind when damaged, and the improved collection aperture and curved chute enabling the vacuum buffer to collect and remove the dust and air combination without the necessity for running an external vacuum pump for ordinary buffing operations. Coincidentally, the present invention can also use a vacuum pump in heavier buffing modes but still benefits from the enhanced sealing and egress of the air dust combination from within the hood. As compared to the '305 vacuum buffer, this arrangement significantly enhances flow conditions under the hood and further minimizes egress of the dust and air combination from the machine at and around the hood 40.

Figure 1:
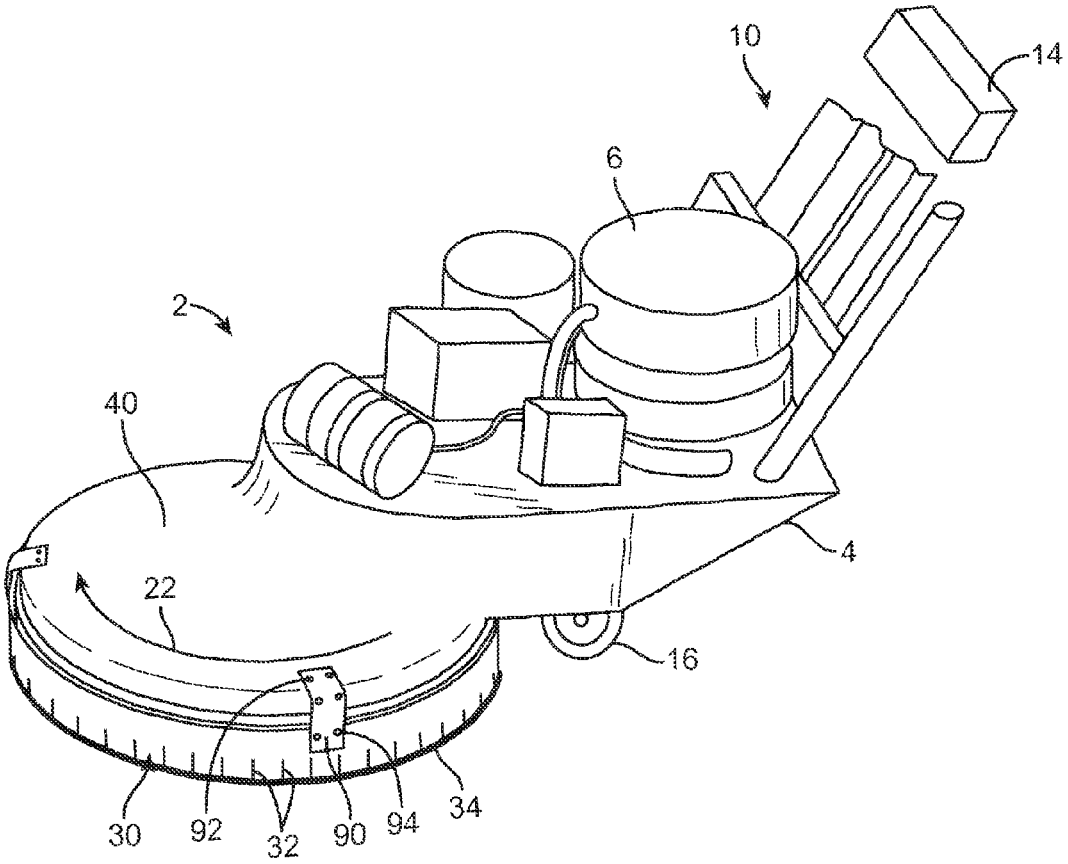
FIG. 1 is a perspective view of the high speed buffer of this invention.

Referring to FIG. 1, the high-speed buffer assembly 2 according to the embodiments of the invention is illustrated. It includes a chassis 4 mounted on wheels 16 for transport over a floor to be polished. The chassis 4 extends from over the wheels to over a high speed buffer pad 20. Powered motor 6 drives the buffer pad 20. Buffer pad 20 rotates and polishes the floor under hood 40, which is under the chassis 4. Simultaneously, motor 6, in certain modes, may power vacuum apparatus 10 which can exhaust accumulated dust from buffing to paper bag filter 14. Skirt 30 depends from the portion of the chassis 4, which extends over the buffer 20.

Skirt 30 is mounted to the chassis 4 by flexible tabs 90. The skirt 30 is capable of moving towards and away from the floor as buffer pad 20 passes in polishing rotation over the floor. Skirt 30 contains louvers 32 at the bottom skirt edge 36, which is the skirt edge nearest the polishing surface. The configuration of these louvers 32 with respect to the periphery of rotating buffer pad 20 enables dust confinement as will be discussed in greater detail below. In one embodiment the skirt 30 has a skirt lip seal 34 attached to the bottom skirt edge 36. The lip skirt seal 34 is u-shaped in cross section and covers the lower skirt edge 36 circumferentially around all or substantially the entire skirt diameter, extending a distance up the face of the skirt 30 partially covering louvers 32. This skirt lip seal 34 enhances the skirt's ability to confine dust inside the skirt 30 and hood 40. In addition to providing a better seal, the lip seal skirt 34 restrains and protects the ends of the louvers so that the louvers don't break or flex.

Figure 9:
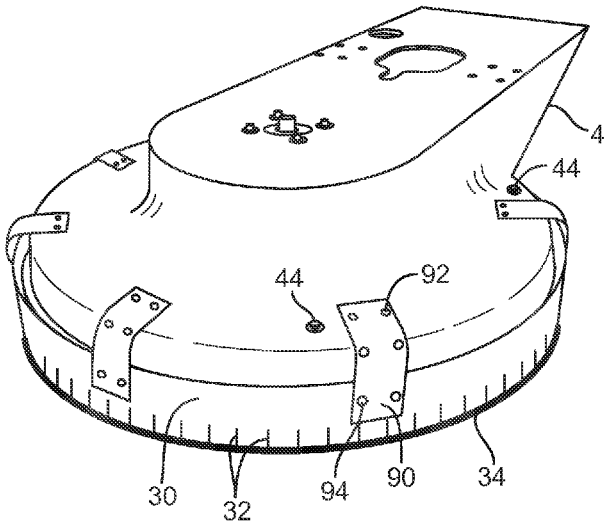

Skirt 30 constitutes a flexible strip fixed to the chassis 4 by tabs 90. Fastening may occur by way of rivets, which affix the tabs 90 to the chassis 4 at one end 92 of the tabs 90 and to the skirt 30 at the other end 94 of the tabs 90. In addition to rivets, alternative means for attaching the tabs 90 to the Skirt 30 may include such fastening means as velcro, tape, screws and other similar fasteners, among other things. This flexible strip allows for multi-directional movement and flexibility of the skirt as it floats over the polishing surface by way of skirt lip seal 34 allowing for rotational, as well as horizontal and vertical movement of the skirt 30 about the hood 40 preventing binding of the skirt itself or the skirt attachment means. These flexible strips eliminate problems with prior art buffers where a bolt and slot attachment was utilized only allowing for vertical movement of the skirt along the hood in the direction of the slot length. In such prior art buffers the bolts would bend when hitting objects during operation, binding skirt 30 and effectively preventing skirt 30 from self-adjusting with floor irregularities, thus causing vacuum loss and dust to escape from under skirt 30. Additionally, the slots themselves allowed for vacuum and dust leakage from the hood 40 reducing efficiency of the apparatus. While FIG. 9 shows five tabs 90, more or less tabs may be used as necessary.

Louvers 32 are placed at intervals around skirt 30 adjacent the floor. Preferably, the louvers 32 have intervals between them in the order of less than two inches. As illustrated louvers 32 slant relative to the direction of rotation of buffer pad 20 at an angle of 45° but angles ranging from 30° to 60° will suffice. This slant, in some embodiments, is such that it is not possible to obtain a line-of-sight view radially from the center of rotation of buffer pad 20 through the louvers 32 to the exterior of skirt 30. Along with the rotation of the Buffer pad 20, the slant of the louvers 32 create inward suction of air and dust at skirt 30.

Figure 2:
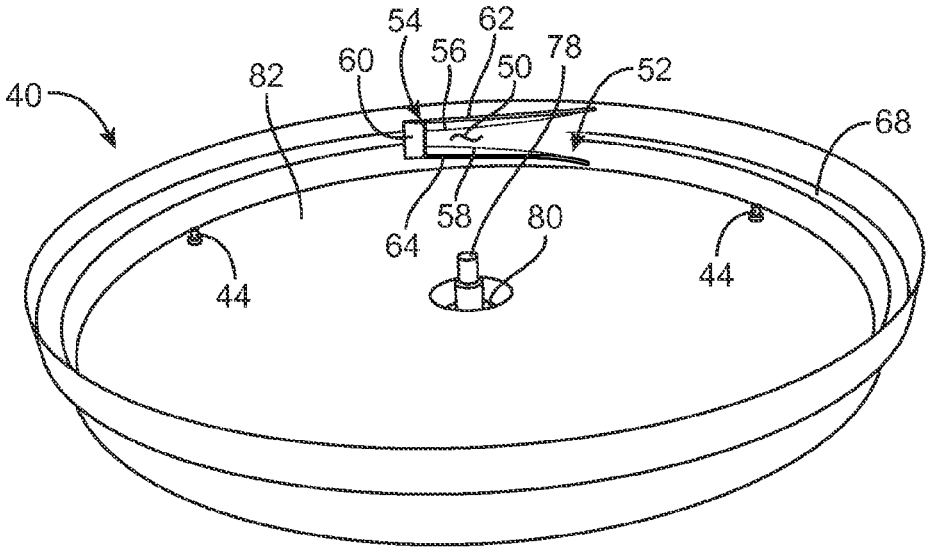
FIG. 2 is an inverted view of the buffer hood illustrating the hood shape and showing the aperture and deflectors.
Figure 3:
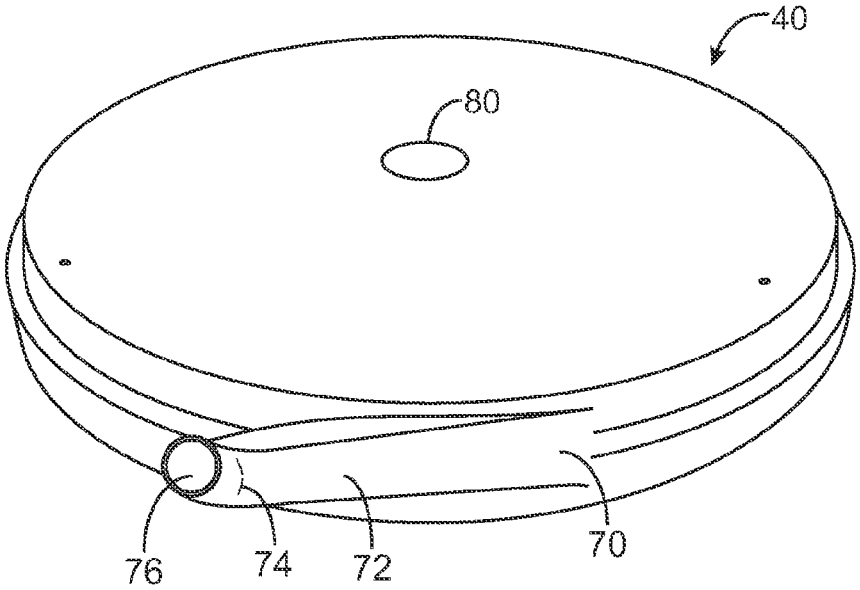
FIG. 3 is a top view of the buffer hood illustrating the hood shape and showing the aperture outlet and exterior curved chute.
Figure 4:
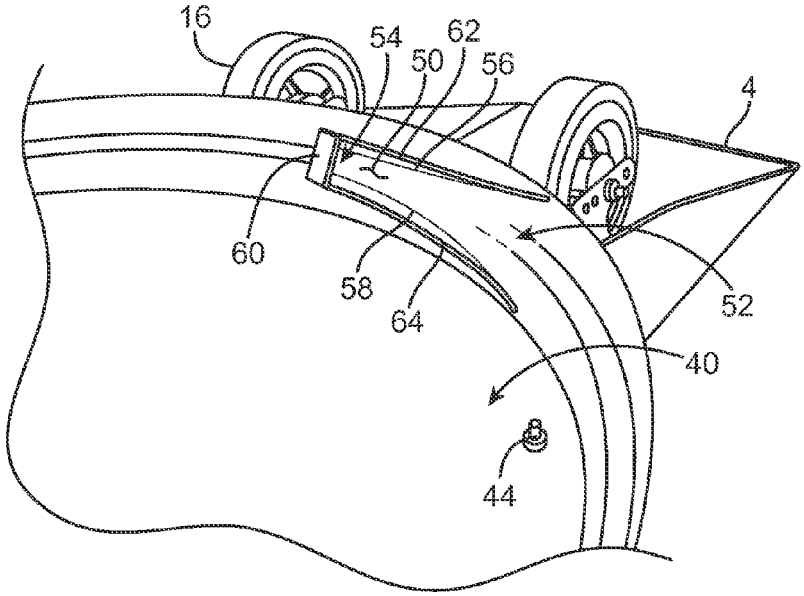
FIG. 4 is an inverted view of a portion of the hood assembled into the chassis without the skirt showing the aperture and chute details.
Figure 5:
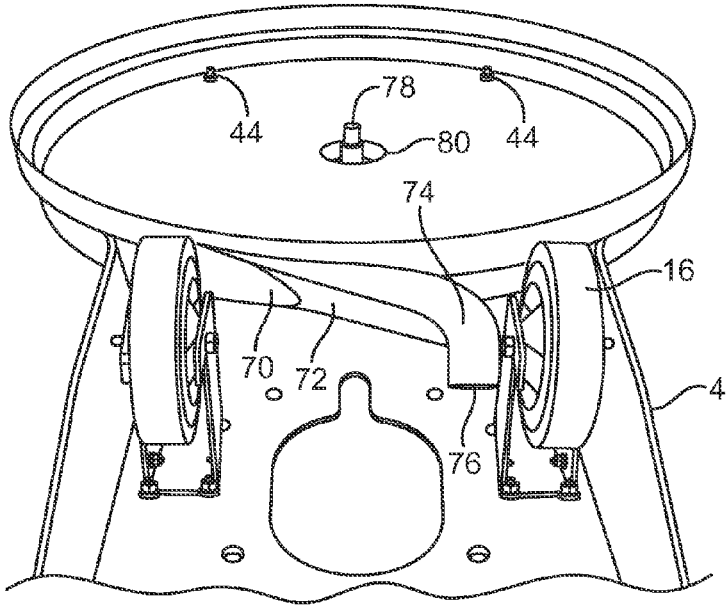
FIG. 5 is an inverted view of the hood assembled into the chassis without the skirt as seen from the rear of the high speed buffer.
Figure 6:
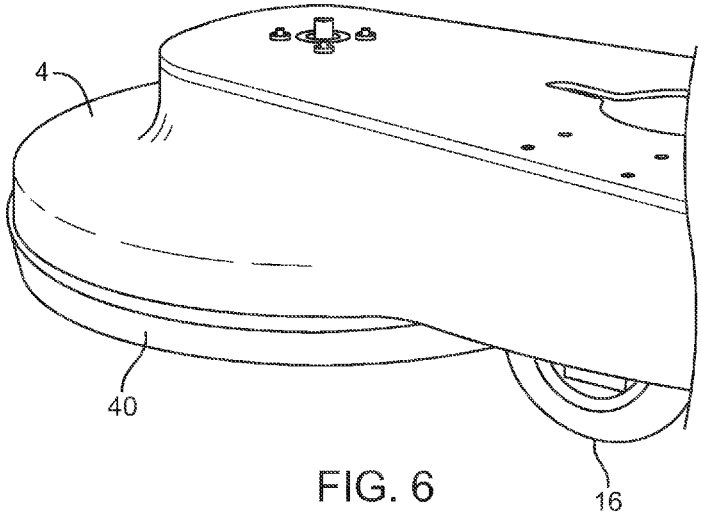
FIG. 6 is a perspective view of the hood component assembled into the chassis.
Figure 10:
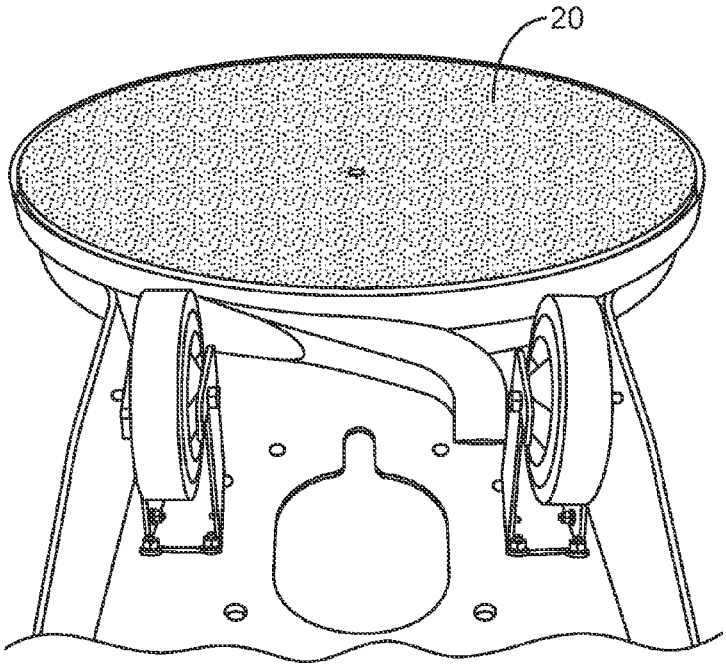
FIG. 10 is an inverted view of the hood assembled into the chassis showing the buffer pad.

The hood 40 is attached to the chassis 4 by way of a plurality of common bolt/nut type fasteners 44 which penetrate through the top surface of the hood 46 and the chassis itself. In FIG. 10, hood 40 is illustrated inverted and buffer pad 20 is shown inside the interior cavity of the hood 40. In FIGS. 2-4 hood 40 is illustrated inverted and buffer pad 20 is not shown so that the interior cavity configuration of the hood 40 can be seen. As can be seen, a raised portion 68 can be seen in depending radial sidewalls of the hood 40, which is the result of two differing diameters of the hood radial sidewalls. Screw mount 78 connects the buffer pad 20 to motor 6, protrudes through an opening 80 in the center of the upper interior surface of the hood 40. The top interior surface of the hood 40 as shown is generally flat and a set distance above the buffer pad 20 whereby the distance between the top side of buffer pad 20 and the top interior surface of hood 40 remains essentially constant.

During buffing, rapidly rotating objects will entrain air adjacent their respective surfaces and thus the high speed buffer pad 20 entrains air and dust under the hood 40 and within the skirt 30, causing air to rapidly rotate under protective hood 40 in the direction of buffer pad rotation 22.

Figure 11:
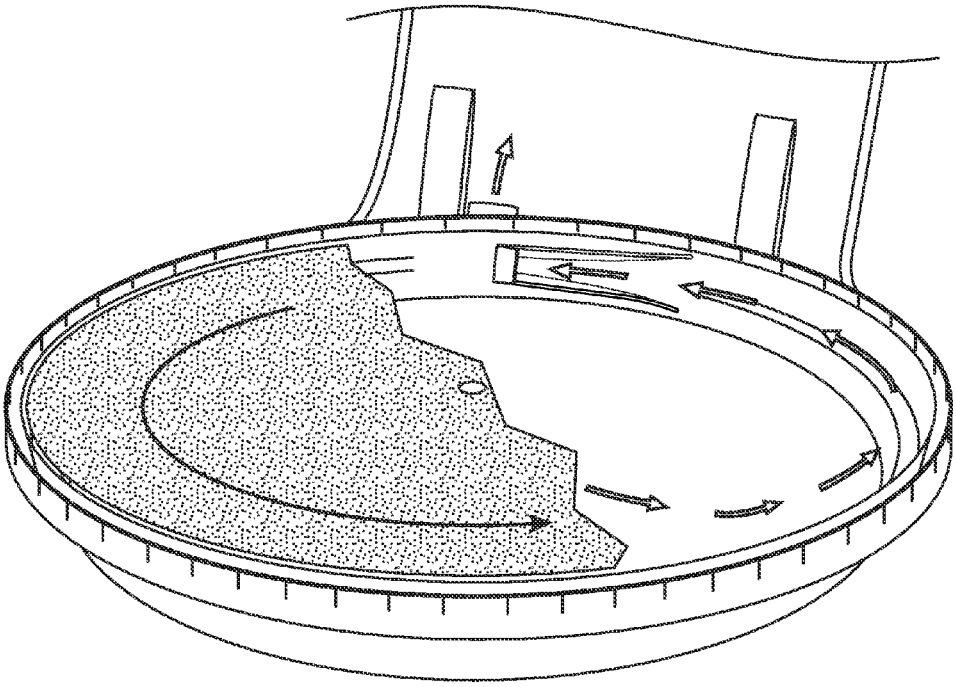
FIG. 11 is an inverted view of the hood and skirt assembled into the chassis showing a partial buffer pad and the direction of circulation of the buffer pad as well as the airflow travel and evacuation of airflow from under the hood.

Utilizing this phenomenon, to collect the dust and air entrained within the hood, a dust collection aperture 50 is located in the depending radial sidewalls of the hood 40. The aperture 50 has a first end 52 and a second end 54, a first side 56 and a second side 58. The first end 52 of the aperture 50 is wider than the second end 54 of the aperture 50. The collection aperture 50 is located adjacent the buffer pad 20 extending through to the exterior of hood 40 through a downward depending radial wall of hood 40. This configuration causes evacuating dust and air to accelerate as it exits the hood 40 through the aperture 50, aiding in the vacuum affect created by the rotationally created entrained air within the skirt 30 and hood 40. The configuration of louvers 32 in skirt 30 at the periphery of hood 40, the raised portion 68 of hood 40 and a collection aperture 50 cooperate to maximally capture centrifugally thrust out dust particles as illustrated in FIG. 11 and direct the air and dust out through the collection aperture 50.

A deflector 60 is located at the distal second end 54 of the aperture 50. The deflector 60 extends inward from the hood 40, and in the embodiment shown, the deflector is angled opposite the rotational direction of buffer pad 20 so as to maximize trapping and redirecting of air and dust being entrained by the buffer pad 20 and deflect the air dust combination through the aperture 50 to exit the hood 40. A first sidewall 62 and second sidewall 64 further assist in redirecting airflow from the edges of the hood where the speed of the airflow is at a maximum, and similarly where maximum dust particles collect, into the converging aperture 50, to a chute 70 and then toward the inlet of the discharge exhaust.

Figure 7:
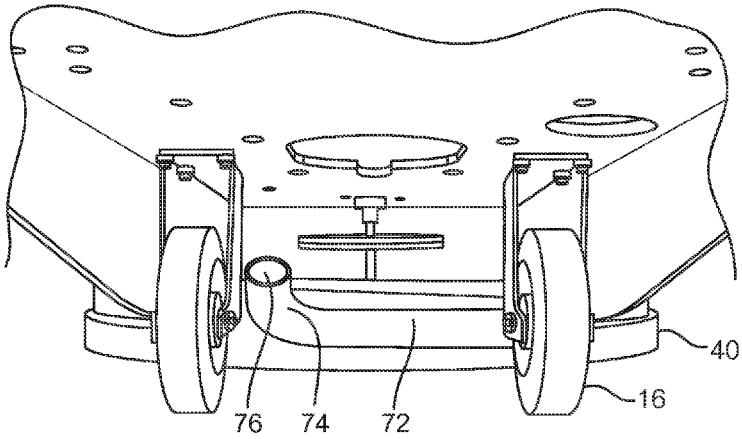
FIG. 7 is a view of the underside of the chassis showing the assembly of the hood component into the chassis and showing the aperture chute.
Figure 8:
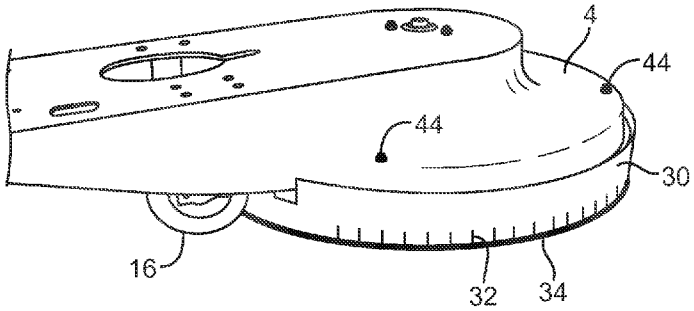
FIG. 8 is a side perspective view of the hood component assembled into the chassis with the skirt and skirt seal; and, FIG. 9 is a front perspective view of the hood component assembled into the chassis with the skirt and skirt seal.

As can be seen in FIGS. 3 and 7, at the exterior of the hood 40 and aligned with the aperture 50 which penetrates hood 40, the chute 70 is connected with the exterior of hood 40. This chute 70, at the end 72 that aligns with the aperture 50, has geometry that matches the aperture 50 geometry. The chute 70 converges as it protrudes away from the hood 40 to a shape, which can mate with a collection bag or vacuum hose or other connection at its outlet 76. As shown here, the shape of the chute outlet 76 is cylindrical to mate with a round hose. The chute's second end is configured to communicate with a dust collection bag 14. For compactness, in the embodiment described and shown, the chute 70 is located below the chassis 4 and between the wheels 16. The chute 70 has a smooth curved bend 74, which efficiently directs air through the chute outlet 76 upwardly where it connects with a hose. This curved bend 74 allows for minimal internal turbulence, and thus least vacuum and operational losses of the dust/air transportation through the chute 70. Because the chute 70 extends from the hood 40 at the outlet of the collection aperture 50 in a direction generally horizontal to the floor, the bend 74, efficiently redirects the dust and air traveling from hood 40, outward then upward to a vacuum hose or the collection bag 14. The chute 70 can also connect directly to a vacuum inlet.

Given the combination of the louvers 32, skirt lip seal 34, the collection aperture 50 and the chute 70 geometry, use of a vacuum pump is not required for egress of dust through the collection aperture 50 and the skirt lip seal 34 is able to prevent escape of the dust from under skirt edge 36 without a vacuum pump. Under heavier buffing modes, a vacuum pump may be used to assist with egress of the dust and air combination from the hood 40 and through the collection aperture 50. This vacuum assist when operated draws power from the motor shaft which drives the buffer pad 20 and can be run by various different powering means including propane, battery or off of electricity by way of an electrical cord, among others.

When performing the heavy buffing operations heavy particles are created, such as when buffing cement as opposed to lighter operations which create lighter particles such as polishing wood and polymer floors and both the rotation of buffer pad 20 and the vacuum 10 cooperate to remove dust through dust collection aperture 50, the dust is extremely fine-going down to a particle size in the range of 1 micron. As such, the vacuum 10 usually exhausts to a paper filter for screening out particles having a dimension greater than 1 micron. As a relatively high pressure is required for this type of filtering and buffering, the interaction of the air impelled by buffer pad 20 in coordination with vacuum pump 10 provides the greater vacuum suction typically necessary for this particularly type of buffing.

As will be understood by those skilled in the art, the present invention may be embodied in other specific forms without departing from the essential characteristics thereof. Many other embodiments are possible without deviating from the spirit and scope of the invention. These other embodiments are intended to be included within the scope of the present invention, which is set forth in the following claims.

What is claimed is:

1. A dust evacuation system for a high speed power buffing assembly wherein said buffing assembly includes a chassis mounted for movement along a directed path over a surface to be polished, a motor mounted to said chassis, a high speed polishing buffer depending from said chassis driven by said motor in rotating contact with the floor along a preselected direction of rotation, the dust evacuation system, comprising:

a hood depending from said chassis to encircle said high speed rotating buffer a peripheral skirt depended from said chassis immediate the periphery of said hood;

said skirt, at the extremity adjacent the surface to be polished having grooves, said grooves inclined with respect to the radial direction of rotation of said buffer pad, said grooves inclined to slant from outside of the skirt to the inside of the skirt in the direction of buffer disc rotation, said grooves as inclined co-acting with said buffer when rotating to entrain air in the direction of buffer disc rotation from the outside of the skirt to the inside of the skirt;

a dust collection aperture adjacent said buffer penetrating said hood for the outlet of dust from inside said hood to the exterior of said hood the aperture having an inlet on the inside of the hood and an outlet on the outside of the hood, the inlet being defined by a first end, a second end, a first side and a second side, the first end being wider than the second end;

a chute, aligned and in communication with the dust collection aperture output on the outside of the hood;

a dust collection bag, communicated with said chute; and, a deflector at the second end of the dust collection aperture, a first sidewall deflector at the first side of the dust collection aperture and a second sidewall deflector at the second side of the dust collection aperture for deflecting air under positive pressure to the dust collection aperture, each of said deflectors protruding into said protective hood.

2. The dust evacuation system for a high speed power buffing assembly according to claim 1 further comprising a vacuum pump having an inlet connected to the chute for drawing suction on the chute and an output for discharging air under positive pressure.

3. A dust evacuation system for a high speed power buffing assembly according to claim 1 wherein said chute has a first end adjacent the dust collection aperture outlet and a second end configured to communicate with said dust collection means wherein the geometry of the first end of the chute corresponds with the dust collection aperture outlet geometry and the second end of the chute is cylindrical.

4. A dust evacuation system for a high speed power buffing assembly according to claim 3 wherein said chute has a bend between the first and second ends of the dust collector output.

5. A dust evacuation system for a high speed power buffing assembly according to claim 1 wherein said dust collection aperture adjacent said buffer defined in said hood to the exterior of said hood extends through a downward depending radial wall of said hood.

6. A dust evacuation system for a high speed power buffing assembly wherein said buffing assembly includes a chassis mounted for movement along a directed path over a surface to be polished, a motor mounted to said chassis, a high speed polishing buffer depending from said chassis driven by said motor in rotating contact with the floor along a preselected direction of rotation, the dust evacuation system, comprising:

a hood depending from said chassis to encircle said high speed rotating buffer a peripheral skirt depended from said chassis immediate the periphery of said hood;

said skirt, at the extremity adjacent the surface to be polished having grooves, said grooves inclined with respect to the radial direction of rotation of said buffer pad, said grooves inclined to slant from outside of the skirt to the inside of the skirt in the direction of buffer disc rotation, said grooves as inclined co-acting with said buffer when rotating to entrain air in the direction of buffer disc rotation from the outside of the skirt to the inside of the skirt;

a lip seal on the extremity of the skirt adjacent the surface to be polished wherein during operation said lip seal contacts the surface to be polished and seals dust within the dust evacuation system;

a dust collection aperture adjacent said buffer penetrating said hood for the outlet of dust from inside said hood to the exterior of said hood the aperture having an inlet on the inside of the hood and an outlet on the outside of the hood, the inlet being defined by a first end, a second end, a first side and a second side, the first end being wider than the second end;

a chute, aligned and in communication with the dust collection aperture output on the outside of the hood; and a dust collection bag, communicated with said chute; and, a deflector at the second end of the dust collection aperture, a first sidewall deflector at the first side of the dust collection aperture and a second sidewall deflector at the second side of the dust collection aperture for deflecting air under positive pressure to the dust collection aperture, each of said deflectors protruding into said protective hood.

7. The dust evacuation system for a high speed power buffing assembly according to claim 6 further comprising a vacuum pump having an inlet connected to the chute for drawing suction on the chute and an output for discharging air under positive pressure.

8. A dust evacuation system for a high speed power buffing assembly according to claim 6 wherein said chute has a first end adjacent the dust collection aperture outlet and a second end configured to communicate with said dust collection means wherein the geometry of the first end of the chute corresponds with the dust collection aperture outlet geometry and the second end of the chute is cylindrical.

9. A dust evacuation system for a high speed power buffing assembly according to claim 8 wherein said chute has a bend between the first and second ends of the dust collector output.

10. A dust evacuation system for a high speed power buffing assembly wherein said buffing assembly includes a chassis mounted for movement along a directed path over a surface to be polished, a motor mounted to said chassis, a high speed polishing buffer depending from said chassis driven by said motor in rotating contact with the floor along a preselected direction of rotation, the dust evacuation system, comprising:

a hood depending from said chassis to encircle said high speed rotating buffer a peripheral skirt depended from said chassis immediate the periphery of said hood;

said skirt, at the extremity adjacent the surface to be polished having grooves, said grooves inclined with respect to the radial direction of rotation of said buffer pad, said grooves inclined to slant from outside of the skirt to the inside of the skirt in the direction of buffer disc rotation, said grooves as inclined co-acting with said buffer when rotating to entrain air in the direction of buffer disc rotation from the outside of the skirt to the inside of the skirt;

a dust collection aperture adjacent said buffer penetrating said hood for the outlet of dust from inside said hood to the exterior of said hood the aperture having an inlet on the inside of the hood and an outlet on the outside of the hood, the inlet being defined by a first end, a second end, a first side and a second side, the first end being wider than the second end;

a chute, aligned and in communication with the dust collection aperture output on the outside of the hood; and a dust collection bag, communicated with said chute; and, a deflector at the second end of the dust collection aperture, a first sidewall deflector at the first side of the dust collection aperture and a second sidewall deflector at the second side of the dust collection aperture for deflecting air under positive pressure to the dust collection aperture, each of said deflectors protruding into said protective hood, wherein the skirt is attached to said chassis by a plurality of tabs extending from the chassis to the skirt.

11. The dust evacuation system for a high speed power buffing assembly according to claim 10 further comprising a vacuum pump having an inlet connected to the chute for drawing suction on the chute and an output for discharging air under positive pressure.

12. A dust evacuation system for a high speed power buffing assembly according to claim 10 wherein said chute has a first end adjacent the dust collection aperture outlet and a second end configured to communicate with said dust collection means wherein the geometry of the first end of the chute corresponds with the dust collection aperture outlet geometry and the second end of the chute is cylindrical.

13. A dust evacuation system for a high speed power buffing assembly according to claim 12 wherein said chute has a bend between the first and second ends of the dust collector output.

14. A dust evacuation system for a high speed power buffing assembly wherein said buffing assembly includes a chassis mounted for movement along a directed path over a surface to be polished, a motor mounted to said chassis, a high speed polishing buffer depending from said chassis driven by said motor in rotating contact with the floor along a preselected direction of rotation, the dust evacuation system, comprising:

a hood depending from said chassis to encircle said high speed rotating buffer a peripheral skirt depended from said chassis immediate the periphery of said hood;

said skirt, at the extremity adjacent the surface to be polished having grooves, said grooves inclined with respect to the radial direction of rotation of said buffer pad, said grooves inclined to slant from outside of the skirt to the inside of the skirt in the direction of buffer disc rotation, said grooves as inclined co-acting with said buffer when rotating to entrain air in the direction of buffer disc rotation from the outside of the skirt to the inside of the skirt;

a lip seal on the extremity of the skirt adjacent the surface to be polished wherein during operation said lip seal contacts the surface to be polished and seals dust within the dust evacuation system;

a dust collection aperture adjacent said buffer penetrating said hood for the outlet of dust from inside said hood to the exterior of said hood the aperture having an inlet on the inside of the hood and an outlet on the outside of the hood, the inlet being defined by a first end, a second end, a first side and a second side, the first end being wider than the second end;

a chute, aligned and in communication with the dust collection aperture output on the outside of the hood; and a dust collection bag, communicated with said chute; and, a deflector at the second end of the dust collection aperture, a first sidewall deflector at the first side of the dust collection aperture and a second sidewall deflector at the second side of the dust collection aperture for deflecting air under positive pressure to the dust collection aperture, each of said deflectors protruding into said protective hood, wherein the skirt is attached to said chassis by a plurality of tabs extending from the chassis to the skirt.

15. The dust evacuation system for a high speed power buffing assembly according to claim 14 wherein said chute has a smoothly curved bend between the dust collection aperture output on the outside of the hood and the dust collection bag.

16. The dust evacuation system for a high speed power buffing assembly according to claim 14 wherein said motor is powered by propane, a battery or electricity by way of an electrical cord.

17. The dust evacuation system for a high speed power buffing assembly according to claim 14 further comprising a vacuum pump having an inlet connected to the chute for drawing suction on the chute and an output for discharging air under positive pressure.

18. A dust evacuation system for a high speed power buffing assembly according to claim 14 wherein said chute has a first end adjacent the dust collection aperture outlet and a second end configured to communicate with said dust collection means wherein the geometry of the first end of the chute corresponds with the dust collection aperture outlet geometry and the second end of the chute is cylindrical.

* * * * *